US009894443B2

(12) United States Patent
Honda et al.

(10) Patent No.: US 9,894,443 B2
(45) Date of Patent: Feb. 13, 2018

(54) LOUDSPEAKER AND MOBILE DEVICE INCORPORATING SAME

(71) Applicant: Panasonic Intellectual Property Management Co., Ltd., Osaka (JP)

(72) Inventors: Kazuki Honda, Osaka (JP); Mitsukazu Kuze, Okayama (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 106 days.

(21) Appl. No.: 15/023,311

(22) PCT Filed: Aug. 21, 2015

(86) PCT No.: PCT/JP2015/004193

§ 371 (c)(1),
(2) Date: Mar. 18, 2016

(87) PCT Pub. No.: WO2016/038812

PCT Pub. Date: Mar. 17, 2016

(65) Prior Publication Data

US 2016/0249137 A1 Aug. 25, 2016

(30) Foreign Application Priority Data

Sep. 10, 2014 (JP) ..... 2014-183938

(51) Int. Cl.
*H04R 9/04* (2006.01)
*H04R 9/06* (2006.01)
(Continued)

(52) U.S. Cl.
CPC ..... *H04R 9/045* (2013.01); *H04R 7/04* (2013.01); *H04R 9/06* (2013.01); *H04R 7/18* (2013.01);
(Continued)

(58) Field of Classification Search
CPC combination set(s) only.
See application file for complete search history.

(56) References Cited

U.S. PATENT DOCUMENTS 6,229,902 B1 * 5/2001 Proni ..... H04R 9/022 381/396
6,449,376 B1 * 9/2002 Beltran ..... H04R 7/04 381/423
(Continued)

FOREIGN PATENT DOCUMENTS

EP 735795 A2 10/1996
FR 2912592 A1 8/2008
(Continued)

OTHER PUBLICATIONS

Speaker with attachable and detachable mechanism, Koike Yoshiyuki, publication No. 07-170586, date Apr. 7, 1995, pp. 1-17, (english translation provided).*
(Continued)

*Primary Examiner* — Duc Nguyen
*Assistant Examiner* — Assad Mohammed
(74) *Attorney, Agent, or Firm* — Greenblum & Bernstein, P.L.C.

(57) ABSTRACT

A loudspeaker includes a frame, a diaphragm, an edge, a magnetic circuit, and a voice coil body. The magnetic circuit includes a magnet and a bottom plate. The bottom plate includes an installation part and a plurality of arms. The installation part is located on the first side of the magnet and is magnetically connected to the magnet. The arms project from the installation part toward the outer periphery and are connected to the frame.

20 Claims, 11 Drawing Sheets

(51) Int. Cl.

| | |
|---|---|
| ***H04R 7/04*** | (2006.01) |
| *H04R 7/18* | (2006.01) |
| *H04R 9/02* | (2006.01) |

(52) U.S. Cl.
CPC ..... *H04R 9/025* (2013.01); *H04R 2201/028* (2013.01); *H04R 2499/13* (2013.01)

(56) References Cited

U.S. PATENT DOCUMENTS

| | | | | |
|---|---|---|---|---|
| 2006/0188124 | A1 | 8/2006 | Sasaki et al. | |
| 2007/0102270 | A1 | 5/2007 | Takashima et al. | |
| 2008/0192976 | A1 | 8/2008 | Kim | |
| 2009/0110210 | A1* | 4/2009 | Ludwig | B60R 11/0217 381/86 |
| 2011/0044491 | A1* | 2/2011 | Ku | H04R 9/022 381/433 |
| 2011/0096952 | A1* | 4/2011 | Wang | H04R 7/125 381/386 |
| 2011/0299716 | A1* | 12/2011 | Reckert | H04R 7/02 381/398 |
| 2012/0269378 | A1* | 10/2012 | Stead | H01F 7/0289 381/396 |

FOREIGN PATENT DOCUMENTS

| | | |
|---|---|---|
| JP | 7-170586 | 7/1995 |
| JP | 2006-229521 | 8/2006 |
| JP | 2007-129678 | 5/2007 |
| JP | 2011-035812 | 2/2011 |

OTHER PUBLICATIONS

The Extended European Search Report dated Jun. 7, 2017 for the related Europen Patent Application No. 15839082.3.
International Search Report of PCT application No. PCT/JP2015/004193 dated Oct. 6, 2015.

* cited by examiner

LOUDSPEAKER AND MOBILE DEVICE INCORPORATING SAME

CROSS-REFERENCE TO RELATED APPLICATIONS

This application is a U.S. national stage application of PCT International Application No. PCT/JP2015/004193 filed on Aug. 21, 2015, which claims the benefit of foreign priority of Japanese patent application 2014-183938 filed on Sep. 10, 2014, the contents all of which are incorporated herein by reference.

TECHNICAL FIELD

The present disclosure relates to an electrodynamic loudspeaker used in audio systems and to a mobile device equipped with the loudspeaker.

BACKGROUND ART

A conventional loudspeaker includes a frame, a diaphragm, a voice coil body, and a magnetic circuit. The diaphragm is connected at its outer peripheral end to the frame via an edge. The magnetic circuit has a magnetic gap and is connected to the frame. The voice coil body includes a bobbin and a voice coil wound near a first end of the bobbin. The bobbin is connected at one end to the diaphragm. The voice coil is located in the magnetic gap.

An example of a conventional technique related to the invention of the present application is shown in Patent Literature 1.

CITATION LIST

Patent Literature

PTL 1: Japanese Unexamined Patent Application Publication No. 2011-35812

SUMMARY OF THE INVENTION

The loudspeaker includes a frame, a diaphragm, an edge, a magnetic circuit, and a voice coil body.

The frame has a cylindrical internal space.

The diaphragm is located in the internal space of the frame.

The edge connects the outer peripheral end of the diaphragm and the frame.

The magnetic circuit includes a magnet and a bottom plate.

The bottom plate includes an installation part and a plurality of arms.

The installation part is located on the first side of the magnet and is magnetically connected to the magnet.

The arms project from the installation part toward the outer periphery and are connected to the frame.

The magnetic circuit is located in the internal space of the frame and has a magnetic gap.

The voice coil body includes a cylindrical bobbin and a voice coil.

The voice coil is wound around at least part of the bobbin.

The voice coil body is located in the center of the diaphragm so that the voice coil can be located in the magnetic gap.

The mobile device of the present disclosure includes a body, a drive part mounted in the body, an amplifier mounted in the body, and the loudspeaker of the present disclosure receiving an output of the amplifier.

DESCRIPTION OF EMBODIMENT

Loudspeakers require a diaphragm and a magnetic circuit located close to each other in order to have a thin profile. Some loudspeakers include two edges instead of a damper in order to support the diaphragm to the frame. Unless the frame and the magnetic circuit have appropriate shapes and are connected properly, loudspeakers have a thick profile.

Such loudspeakers are demanded to have a frame made of resin in terms of productivity and cost. The frame of the loudspeakers, however, has many bent portions and therefore requires an opening for releasing the sound pressure (back pressure) generated on the rear side of the diaphragm. As a result, loudspeakers have a complicated shape, making it sometimes difficult to have a resin frame in terms of productivity and strength.

Figure 1:
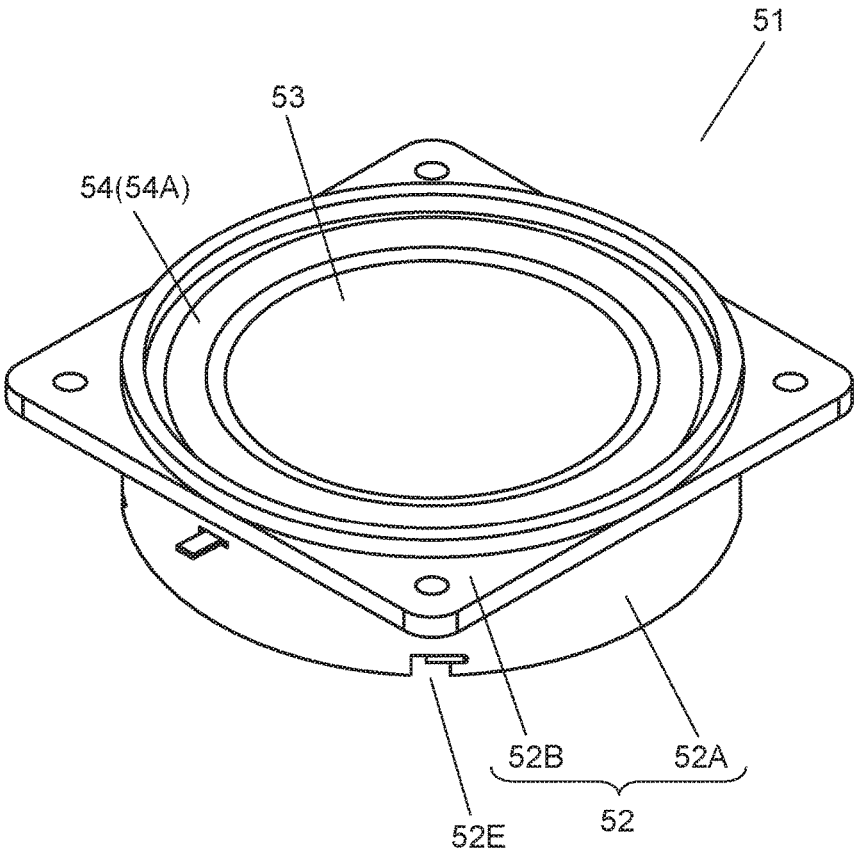
FIG. 1 is a perspective view of a loudspeaker according to a present exemplary embodiment.
Figure 2:
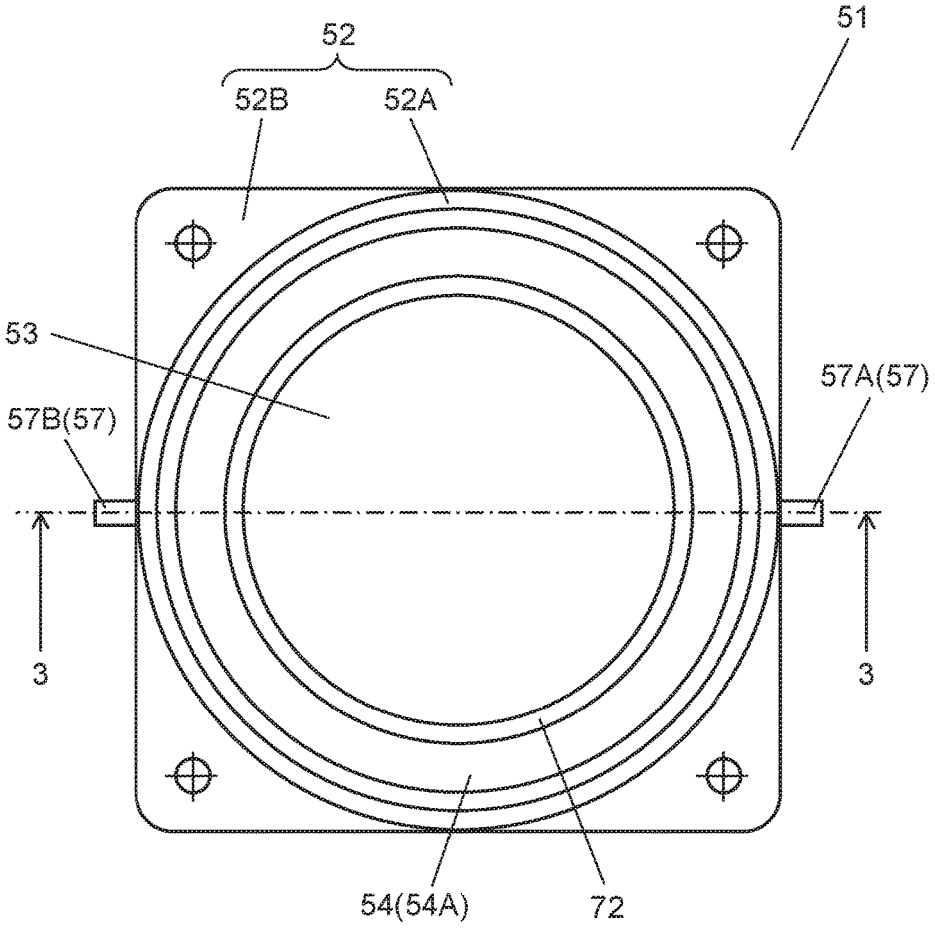
FIG. 2 is a front view of the loudspeaker according to the present exemplary embodiment.
Figure 3:
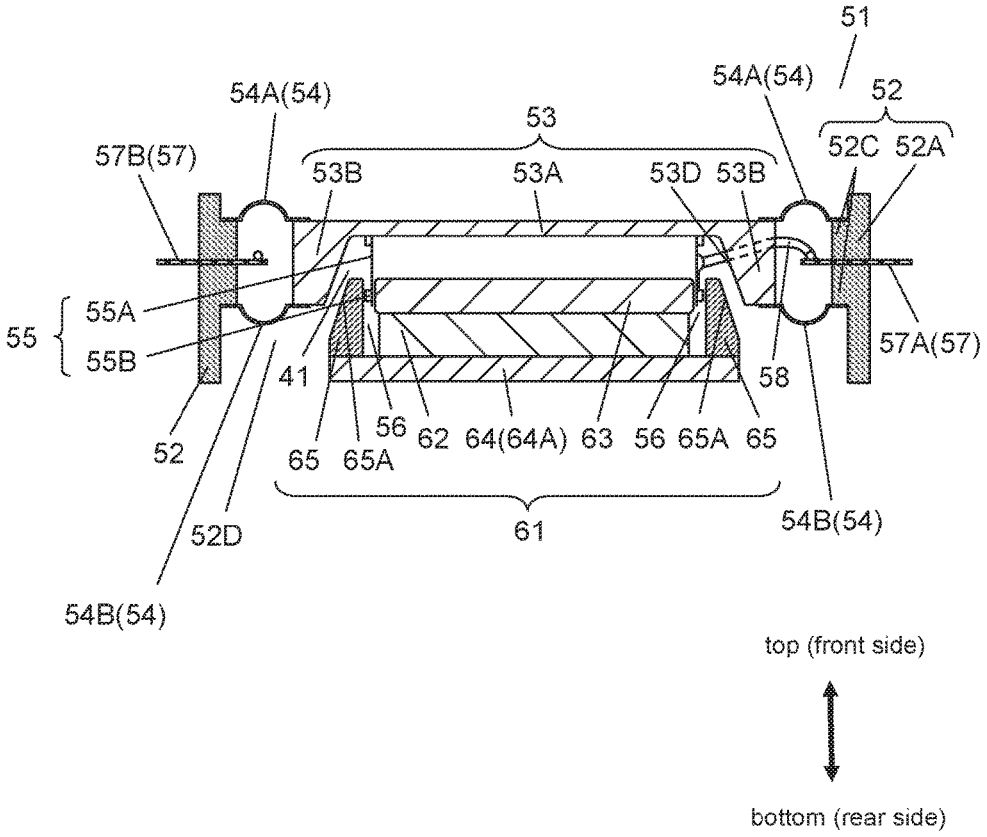
FIG. 3 is a sectional view taken along line 3-3 of FIG. 2.
Figure 4:
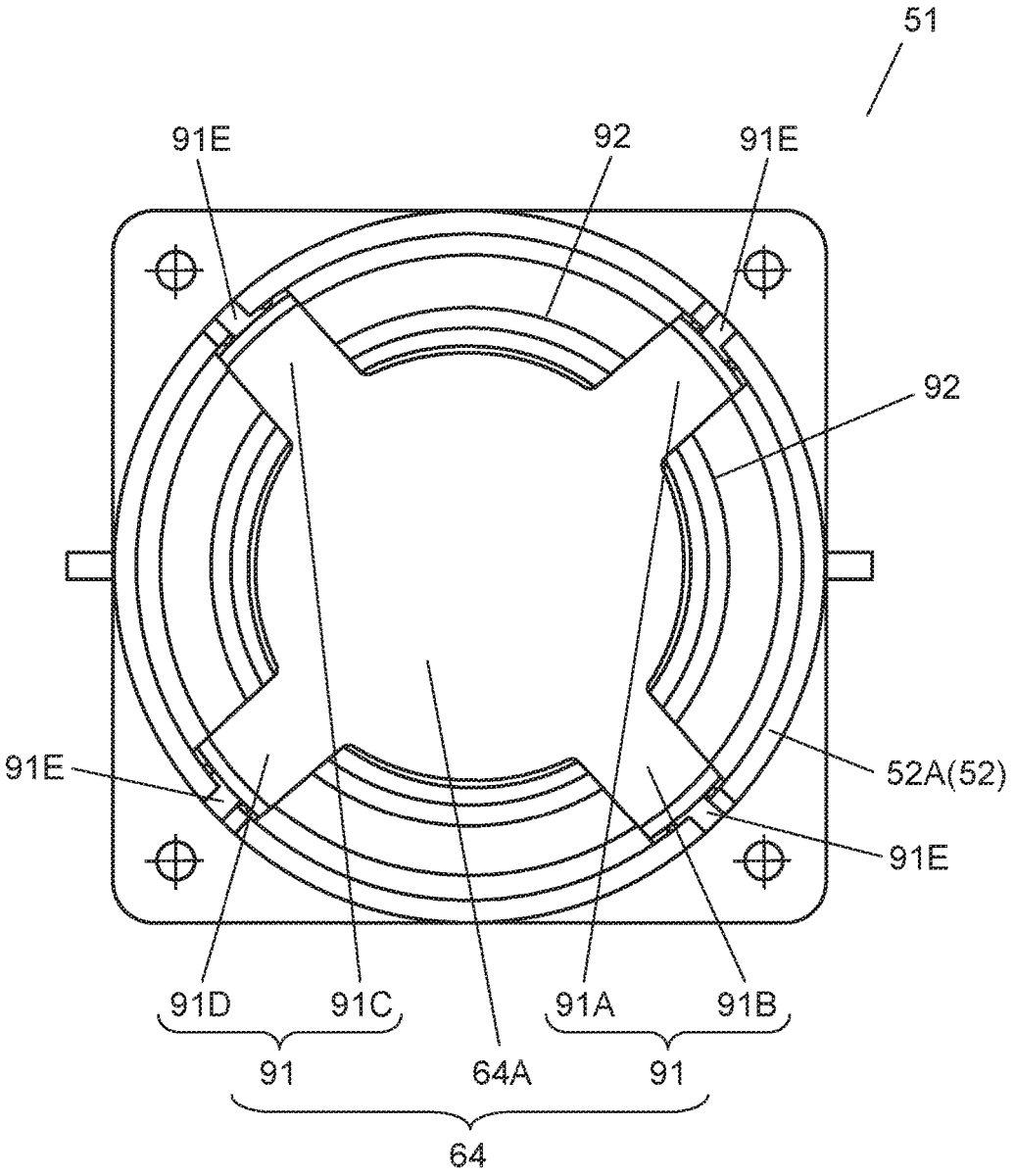
FIG. 4 is a rear view of the loudspeaker according to the present exemplary embodiment.

Loudspeakers come in various shapes depending on the application. For example, in-car loudspeakers need to have a thin profile because they are placed in small spaces such as a dashboard, a door, or a roof. Thin loudspeaker 51 according to the present exemplary embodiment will now be described with reference to drawings. FIG. 1 is a perspective view of loudspeaker 51. FIG. 2 is a front view of loudspeaker 51. FIG. 3 is a sectional view taken along line 3-3 of FIG. 2. FIG. 4 is a rear view of loudspeaker 51. The term "upward direction" represents the direction from magnetic circuit 61 toward diaphragm 53, and the term "downward direction" represents the direction from diaphragm 53 toward magnetic circuit 61 in FIG. 3. In FIG. 3, the upward direction is toward the front side of diaphragm 53, and the downward direction is toward the rear side of diaphragm 53. In FIG. 4, arms 91 are composed of arms 91A-91D.

Loudspeaker 51 includes frame 52, diaphragm 53, edge 54, magnetic circuit 61, and voice coil body 55.

Frame 52 has cylindrical internal space 52D.

Diaphragm 53 is located in internal space 52D of frame 52.

Edge 54 connects the outer peripheral end of diaphragm 53 and frame 52.

Magnetic circuit 61 includes magnet 62 and bottom plate 64.

Bottom plate 64 includes installation part 64A and arms 91.

Installation part 64A is located on the first side of magnet 62 and is magnetically connected to magnet 62.

Arms 91 project from installation part 64A toward the outer periphery and are connected to frame 52.

Magnetic circuit 61 is located in internal space 52D of frame 52 and has magnetic gap 56.

Voice coil body 55 includes cylindrical bobbin 55A and voice coil 55B.

Voice coil 55B is wound around at least part of bobbin 55A.

Voice coil body 55 is located in the center (thin part 53A) of diaphragm 53, so that voice coil 55B can be located in magnetic gap 56.

The above-described configuration allows loudspeaker 51 to have a thin profile.

Magnetic circuit 61 and frame 52 are connected together via arms 91 and therefore, each two adjacent arms 91 are separated by an opening. As a result, frame 52 does not have to have an opening for releasing the sound pressure generated on the rear side of diaphragm 53, allowing frame 52 to have a simple shape. The sound pressure from the rear side of diaphragm 53 allows air to pass through the openings, thereby improving the effect of air-cooling magnetic circuit 61.

Figure 5:
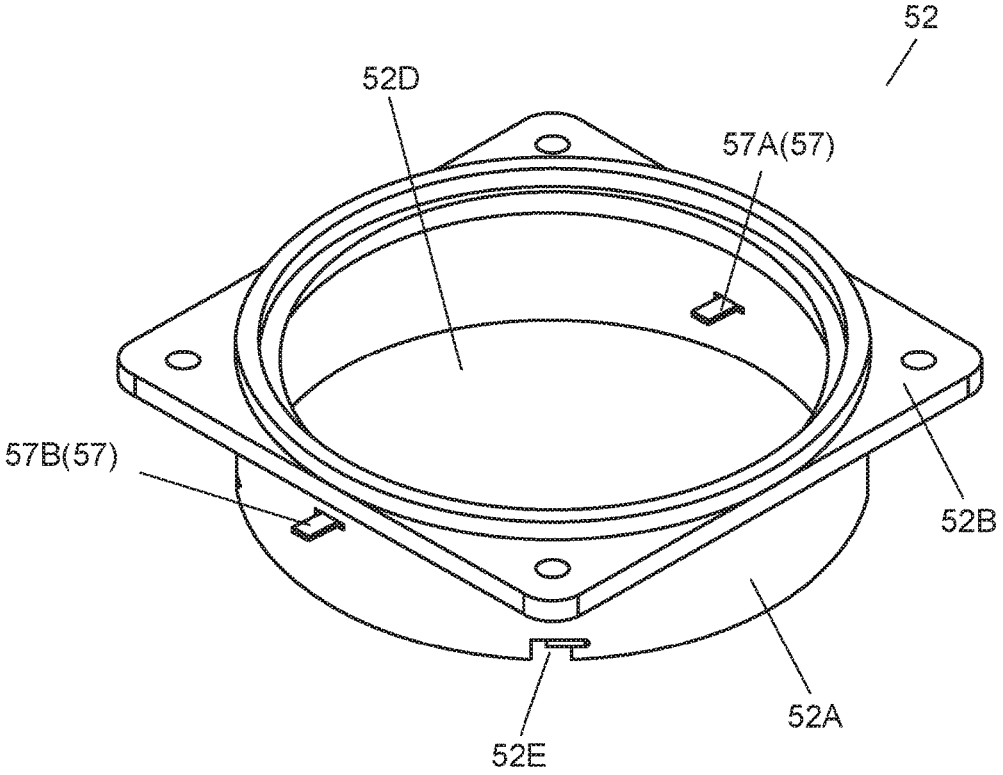
FIG. 5 is a perspective view of a frame of the loudspeaker according to the present exemplary embodiment.

Loudspeaker 51 will now be described in more detail. FIG. 5 is a perspective view of frame 52 of loudspeaker 51. As shown in FIG. 5, frame 52 includes base 52A and attachment part 52B. Base 52A is a hollow cylinder, and in other words, has cylindrical internal space 52D where diaphragm 53 and magnetic circuit 61 are located. Base 52A is preferably cylindrical in the case that diaphragm 53 is circular when seen from the front. Frame 52 does not have to include attachment part 52B, but preferably includes it for the following reason. Attachment part 52B allows loudspeaker 51 to be attached to a baffle board (not shown) or other device. If attachment part 52B has screw holes, loudspeaker 51 can be screwed to the baffle board.

Loudspeaker 51 preferably includes terminal 57. The term "terminal 57" is used to collectively refer to positive terminal 57A and negative terminal 57B. Terminal 57 is fixed to the lateral side of base 52A of frame 52.

As shown in FIG. 3, diaphragm 53 has thin part 53A and thick part 53B formed around thin part 53A. Thin part 53A and thick part 53B define recess 41. Thick part 53B is formed on the outer periphery of diaphragm 53, and recess 41 is formed in the center of the rear side of diaphragm 53. The upper surface of magnetic circuit 61 is located facing thin part 53A.

Thin part 53A is thinner than thick part 53B, and the upper surface of magnetic circuit 61 is located facing thin part 53A. As a result, the distance can be small between the upper surface of magnetic circuit 61 and the front side of diaphragm 53, allowing the loudspeaker to have a thin profile. Furthermore, thick part 53B formed on the outer periphery of diaphragm 53 increases the strength of diaphragm 53.

Figure 6:
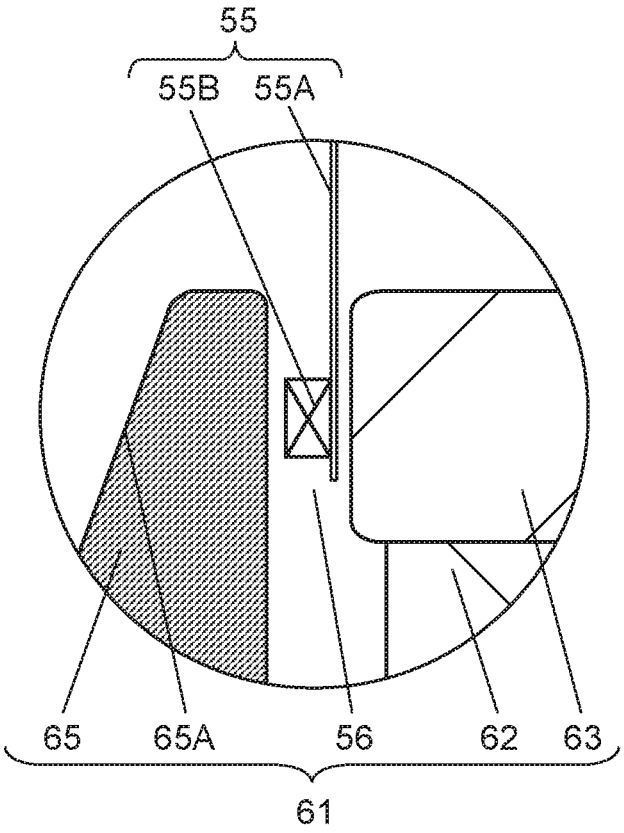
FIG. 6 is an enlarged sectional view of an essential part of a magnetic gap in the loudspeaker according to the present exemplary embodiment.

FIG. 6 is an enlarged sectional view of an essential part of magnetic gap 56 of loudspeaker 51. Voice coil body 55 includes cylindrical bobbin 55A and voice coil 55B wound around at least part of bobbin 55A. The term "cylindrical" here includes rectangular-column shaped. One end of bobbin 55A, or in other words, the first end (front side part) of bobbin 55A, is connected to thin part 53A of recess 41. Voice coil 55B is wound near the second end (rear side part) of bobbin 55A and is located in magnetic gap 56. When a drive signal is supplied to voice coil 55B, diaphragm 53 vibrates according to the direction and magnitude of the drive signal. Diaphragm 53 is driven in the direction of the winding axis of voice coil 55B (vertical direction in FIG. 3) via bobbin 55A.

The term "edge 54" is used to collectively refer to first edge 54A and second edge 54B. First edge 54A and second edge 54B connect the outer peripheral end of diaphragm 53 and frame 52. Second edge 54B is preferably opposite to first edge 54A in the thickness direction of thick part 53B.

Terminal 57 is located between first edge 54A and second edge 54B in the thickness direction of diaphragm 53 and is connected to connecting wire 58 (tinsel wire). Connecting wire 58 passes through a hole formed in thick part 53B and is led out to the rear side of thin part 53A of diaphragm 53. The start and end points of the wire of voice coil 55B are connected to connecting wire 58 on bobbin 55A. The drive signal to drive loudspeaker 51 is supplied to voice coil 55B through terminal 57 via connecting wire 58.

Frame 52 preferably has affixing part 52C. In this case, the outer peripheries of first and second edges 54A and 54B are affixed to affixing part 52C. To achieve this, affixing part 52C is formed near the end of the front side of base 52A. Affixing part 52C is formed on the inner peripheral surface of base 52A in such a manner as to project toward the center of base 52A. Frame 52 is preferably made of synthetic resin. This configuration allows attachment part 52B and affixing part 52C to be integrally formed with base 52A, thereby having a high productivity of frame 52.

Affixing part 52C preferably has an upper surface to which the outer periphery of first edge 54A is affixed and a lower surface to which second edge 54B is affixed. As a result, first and second edges 54A and 54B can be properly connected to frame 52 and have a proper spacing between them, thereby reducing the distortion of loudspeaker 51.

Affixing part 52C is not limited the structure to affix both of first edge 54A and second edge 54B to the lateral side of diaphragm 53. Alternatively, affixing part 52C may be used to affix either one of first edge 54A and second edge 54B to the lateral side of diaphragm 53. Further alternatively, either one of edges 54A and 54B may be directly affixed to the inner peripheral surface of base 52A.

The outer peripheral end of diaphragm 53 is connected to frame 52 via first and second edges 54A and 54B. The direction of the vibration (amplitude) of diaphragm 53 (vertical direction in FIG. 3) is perpendicular to the direction of the magnetic flux in magnetic gap 56. Thus, diaphragm 53 is displaced in the direction of the winding axis of voice coil 55B (vertical direction in FIG. 3) by first and second edges 54A and 54B.

First edge 54A is located on the front side of diaphragm 53 with respect to the center in the thickness direction of diaphragm 53, and second edge 54B is located on the rear side of diaphragm 53 with respect to the center in the thickness direction of diaphragm 53.

First edge 54A and second edge 54B are preferably symmetrical with respect to the plane perpendicular to the direction of the winding axis of voice coil 55B. This configuration allows diaphragm 53 to generate less rolling action, and to cause less distortion due to the asymmetry of the amplitude of diaphragm 53. It is further preferable that first edge 54A and second edge 54B be symmetrical with respect to the center in the thickness direction of diaphragm 53.

It is also preferable to connect first edge 54A with the front side of diaphragm 53 and to connect second edge 54B with the rear side of thick part 53B. In this case, joint 72 is formed parallel with the front or rear side of diaphragm 53. This configuration can provide a large distance between first edge 54A and second edge 54B, making diaphragm 53 have much less rolling action. Joint 72 joins diaphragm 53 and edge 54 (see FIG. 2).

First edge 54A and diaphragm 53 may alternatively be connected together at a location away from the front-side end on the lateral side of diaphragm 53 toward the rear side, allowing loudspeaker 51 shown in FIG. 3 to have a thinner profile.

Diaphragm 53 is preferably made of foamed resin so as to allow diaphragm 53 to be lightweight. The front side of diaphragm 53 is preferably flat.

The rear side of thin part 53A is flat, and in thin part 53A, diaphragm 53 has a uniform thickness.

It is preferable that the boundary portion between thin part 53A and thick part 53B gradually increase in thickness toward the outer periphery of diaphragm 53. More specifically, it is preferable to form inclined surface 53D gradually increasing in thickness from thin part 53A toward thick part 53B so as to enhance the strength of diaphragm 53.

Diaphragm 53 is preferably composed of core material made of foamed resin and a reinforcement layer formed on at least one of the front and rear sides of the core material. The reinforcement layer can be made of carbon or metal like aluminum or titanium.

Furthermore, the upper surface of magnetic circuit 61 is preferably located closer to the front side of diaphragm 53 than to the rear side of thick part 53B as shown in FIG. 3. In short, it is preferable that part of the magnetic circuit be located in thin part 53A so as to allow loudspeaker 51 to have a thin profile.

It is preferable to form tapered part 65A on the lateral side of magnetic circuit 61. In this case, inclined surface 53D is preferably located facing tapered part 65A so as to have the distance large enough to displace the amplitude of diaphragm 53 in the axial direction of the voice coil between diaphragm 53 and magnetic circuit 61. This allows the upper surface of magnetic circuit 61 and the front side of diaphragm 53 to be located close to each other.

Magnetic circuit 61 is preferably of internal magnet type so as to allow thin part 53A to have a small area, and hence, diaphragm 53 to have high strength. Magnetic circuit 61 of internal magnet type includes magnet 62, top plate 63, bottom plate 64, and yoke 65. Magnet 62 is columnar and is magnetized in the vertical thickness direction. Top plate 63 is planar and is placed on the upper surface of magnet 62. Bottom plate 64 has installation part 64A and arms 91. Magnet 62 is placed on the upper surface of installation part 64A. Bottom plate 64 is magnetically connected to magnet 62. Yoke 65 extends upward from the outer peripheral end of the upper side of installation part 64A, and is magnetically connected to magnet 62 via bottom plate 64. Top plate 63, installation part 64A, and yoke 65 are made of magnetic material, such as hot-rolled steel plates (for example, SPHC and SPHD).

Figure 7:
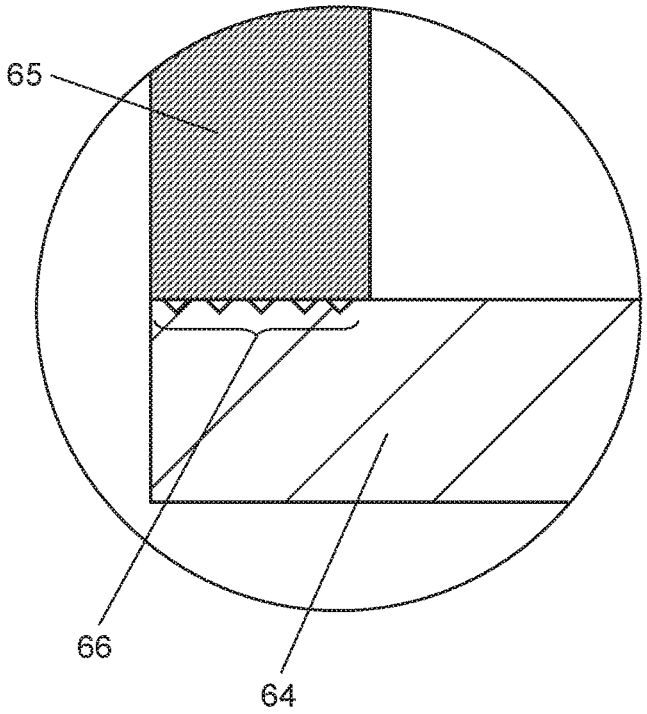
FIG. 7 is a sectional view of a bonding area where a bottom plate and a yoke are bonded together in the loudspeaker according to the present exemplary embodiment.

FIG. 7 is a sectional view of a bonding area where bottom plate 64 and yoke 65 are bonded together in loudspeaker 51. It is preferable that bottom plate 64 and yoke 65 be bonded together with an adhesive. In addition, as shown in FIG. 7, it is possible to form recess 66 for holding the adhesive on the bonding surface between bottom plate 64 and yoke 65. Recess 66 is only required to be formed on at least one of bottom plate 64 and yoke 65. Recess 66 is composed of, for example, grooves of V-shaped cross section and can be formed by knurling the bonding surface of at least one of bottom plate 64 and yoke 65. The adhesive held in recess 66 allows bottom plate 64 and yoke 65 to be tightly bonded together.

Magnet 62 magnetizes top plate 63 and yoke 65 with opposite polarities. The inner peripheral surface of yoke 65 is located facing the outer peripheral surface of top plate 63 so as to form magnetic gap 56 therebetween as shown in FIG. 3. In the case that top plate 63 is magnetized with the north pole and that yoke 65 is magnetized with the south pole, the magnetic flux in magnetic gap 56 flows from top plate 63 to yoke 65.

It is preferable to form tapered part 65A on the outer peripheral surface of yoke 65. In other words, yoke 65 is preferably tapered from bottom plate 64 toward its tip. As a result, tapered part 65A, which tapers from the lower surface toward the upper surface, is formed on the outer peripheral surface of magnetic circuit 61. Tapered part 65A may be linear, curved (such as arc-shaped), step-like, or of a combination of them.

Inclined surface 53D is thicker than thin part 53A, so that diaphragm 53 can be stronger and less deformed in the region having inclined surface 53D. This prevents inclined surface 53D from colliding with tapered part 65A regardless of the small distance between them. As a result, diaphragm 53 can be made thick in inclined surface 53D, and hence improved in strength.

Magnetic circuit 61 is preferably circular when seen from the front, and in this case, magnet 62 is preferably cylindrical. Top plate 63 is preferably disc-shaped, and in this case, diaphragm 53 is preferably either circular or oval when seen from the front.

Instead of being circular, magnetic circuit 61 may be oval or rectangular when seen from the front. In the case that magnetic circuit 61 is oval, bobbin 55A and top plate 63 are preferably oval when seen from the front, and diaphragm 53 is preferably either oval or rectangular when seen from the front. Meanwhile, in the case that magnetic circuit 61 is rectangular, bobbin 55A and diaphragm 53 are preferably rectangular when seen from the front.

Magnet 62 is preferably formed of a neodymium magnet because of its high energy product. This achieves a desired magnetic flux density in magnetic gap 56, allowing magnet 62 and hence the loudspeaker to have a thin profile.

Arms 91 will now be described in detail. As shown in FIG. 4, bottom plate 64 includes installation part 64A and a plurality of arms 91. Arms 91 extend from installation part 64A toward the outer periphery and are connected to frame 52. With this configuration, magnetic circuit 61 is connected to frame 52 via arms 91.

Figure 8:
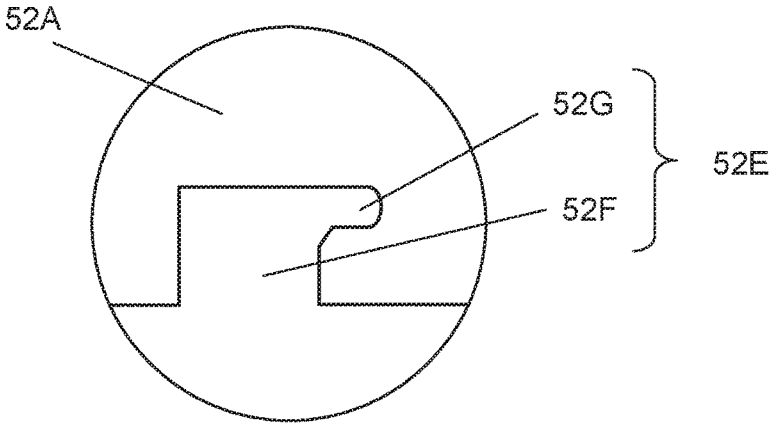
FIG. 8 is an enlarged view of a to-be-engaged portion of a frame in the loudspeaker according to the present exemplary embodiment.

As shown in FIG. 4, arms 91 preferably have engaging portions 91E at their respective tips. Engaging portions 91E can be, for example, projections such as bumps. FIG. 8 is an enlarged view of to-be-engaged portion 52E of frame 52 in loudspeaker 51. As shown in FIG. 8, it is preferable that base 52A of frame 52 have to-be-engaged portions 52E, which are recesses such as grooves or cutouts, for example. Engaging portions 91E of arms 91 are engaged with to-be-engaged portions 52E of frame 52.

Engaging portions 91E shown in FIG. 4 project from the tips of arms 91 and have a smaller width than arms 91 have. Meanwhile, as shown in FIG. 5, to-be-engaged portions 52E are holes formed at the bottom on the outer side (the side far from diaphragm 53) of frame 52. As shown in FIG. 8, each to-be-engaged portion 52E includes insertion slot 52F and locking portion 52G. Insertion slots 52F are wider than engaging portions 91E shown in FIG. 4. Locking portions 52G are formed contiguous with and inside insertion slots 52F. Locking portions 52G are wider than insertion slots 52F in the circumferential direction of base 52A.

Engaging portions 91E shown in FIG. 4 are inserted into locking portions 52G through insertion slots 52F of to-be-engaged portions 52E shown in FIG. 8. More specifically, engaging portions 91E of all arms 91 shown in FIG. 4 are inserted into locking portions 52G of the respective to-be-engaged portions 52E. After this, frame 52 is rotated along the circumference of base 52A with respect to magnetic circuit 61 so that engaging portions 91E are engaged with the respective to-be-engaged portions 52E. After being engaged with each other, engaging portions 91E (see FIG. 4) and to-be-engaged portions 52E (see FIGS. 5 and 8) are preferably bonded together with an adhesive so as to prevent resonance. Thus, magnetic circuit 61 is connected to frame 52 via arms 91.

In FIG. 4, bottom plate 64 includes four arms 91A-91D extending in four directions perpendicular to each other. Each two adjacent arms 91 are separated by opening 92. Openings 92 allow diaphragm 53 to vibrate without being disturbed by the sound pressure (back pressure) from its rear side. Openings 92 also prevent the magnetic flux in magnetic circuit 61 from leaking to arms 91, thereby increasing the magnetic flux density in magnetic gap 56.

Installation part 64A and arms 91 are preferably integrally formed. This configuration makes it unnecessary to use a member for fixing magnetic circuit 61 to frame 52, thereby making bottom plate 64 thin and low cost. Alternatively installation part 64A and arms 91 may be formed separately and combined together. In this case, it is preferable that installation part 64A be made of magnetic material, and that arms 91 be made of non-magnetic material. This configuration reduces magnetic field leakage to arms 91 and increases the magnetic flux density in magnetic gap 56.

Figure 9:
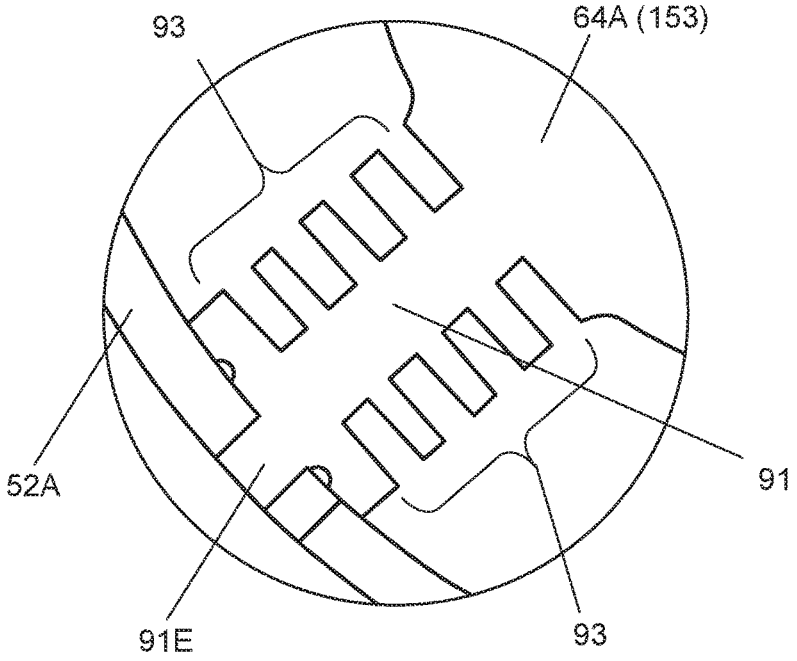
FIG. 9 is an enlarged view of fins formed on arms in the loudspeaker according to the present exemplary embodiment.

FIG. 9 is an enlarged view of fins 93 formed on arms 91 in loudspeaker 51. As shown in FIG. 9, it is possible to provide fins 93 on the outer periphery of arms 91 so as to increase the surface area of arms 91, thereby efficiently cooling magnetic circuit 61.

Figure 10:
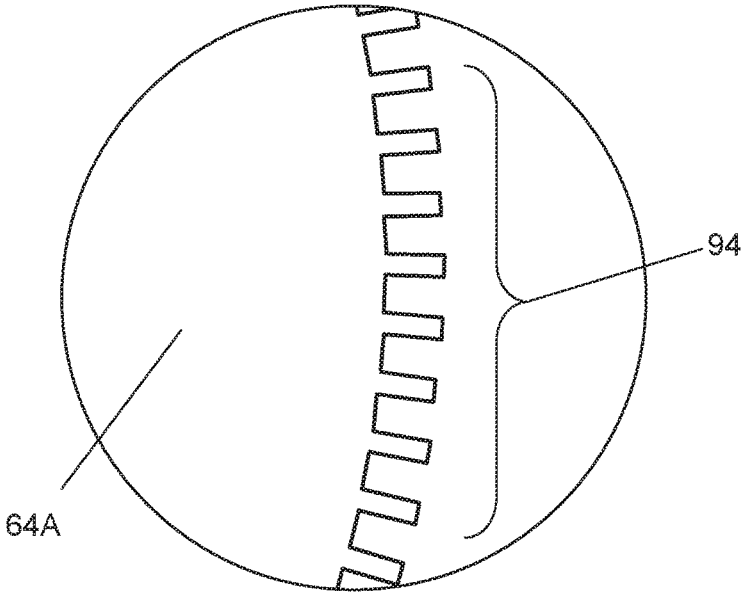
FIG. 10 is an enlarged view of fins formed on an installation part in the loudspeaker according to the present exemplary embodiment.

FIG. 10 is an enlarged view of fins 94 formed on installation part 64A in loudspeaker 51. As shown in FIG. 10, bottom plate 64 may have fins 94 on the outer periphery of installation part 64A. Fins 94 increase the surface area of bottom plate 64, thereby efficiently cooling magnetic circuit 61.

Bottom plate 64 can be a flat metal plate, so that fins 93 and 94 can be formed integrally with bottom plate 64 by sheet metal working, thereby having a high productivity of loudspeaker 51.

Base 52A of frame 52 is formed in cylindrical shape. Base 52A has a simple shape because of not having bent portions or an opening for releasing the back pressure of the diaphragm. Thus, frame 52 of the present embodiment can have a simple shape.

Figure 11:
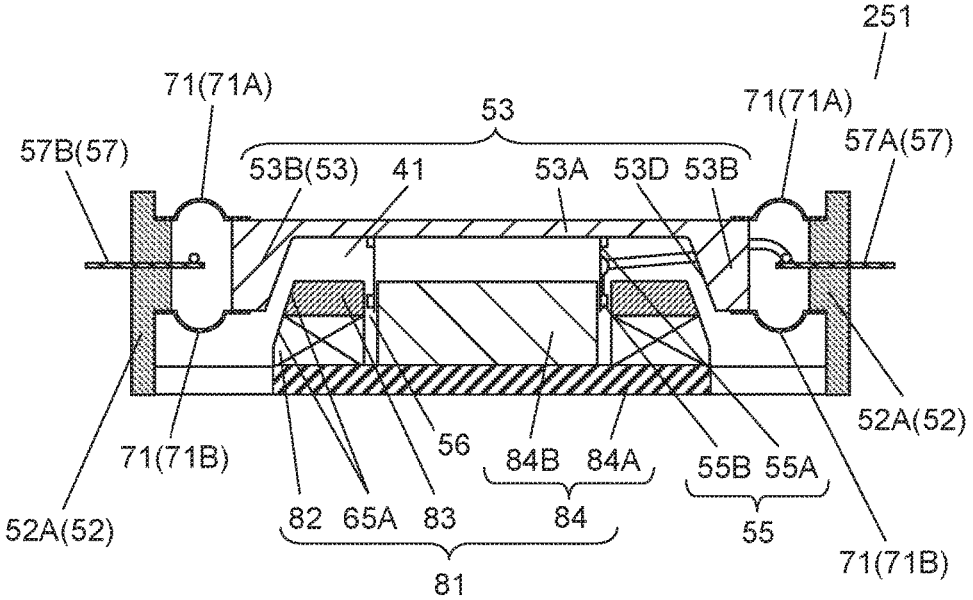
FIG. 11 is a sectional view of another loudspeaker according to the present exemplary embodiment.

Instead of being of the internal magnet type, magnetic circuit 61 may be of external magnet type or a combination of the internal and external magnet types. FIG. 11 is a sectional view of another loudspeaker 251 according to the present exemplary embodiment. In loudspeaker 251, the same components as in loudspeaker 51 are denoted by the same reference numerals, and the description thereof will be omitted.

Loudspeaker 251 includes magnetic circuit 81 of external magnet type instead of magnetic circuit 61 of internal magnet type. Magnetic circuit 81 includes ring-shaped magnet 82, ring-shaped top plate 83, and bottom plate 84. Bottom plate 84 includes installation part 84A and center pole 84B. Center pole 84B extends upward from the center of installation part 84A. Magnet 82 is placed on the upper surface of installation part 84A, which is located outside center pole 84B. Top plate 83 is placed on the upper surface of magnet 82. The outer peripheral surface of center pole 84B is located facing the inner peripheral surface of top plate 83, and magnetic gap 56 is formed therebetween.

In the case that magnetic circuit 81 of external magnet type is used, center pole 84B is used as the yoke located facing top plate 83.

Thus, magnetic circuit 81 is located facing thin part 53A, so that loudspeaker 251 can have a thin profile even in the case that magnetic circuit 81 is of external magnet type.

It is preferable that tapered part 65A be formed on the outer peripheral surface of top plate 83 and that tapered part 65A be located facing inclined surface 53D of recess 41. Magnet 82 may be a bond magnet so as to be formed into a variety of shapes. Tapered part 65A is also preferably formed on the outer peripheral surface of magnet 82. Tapered part 65A and inclined surface 53D are preferably located facing each other.

Figure 12:
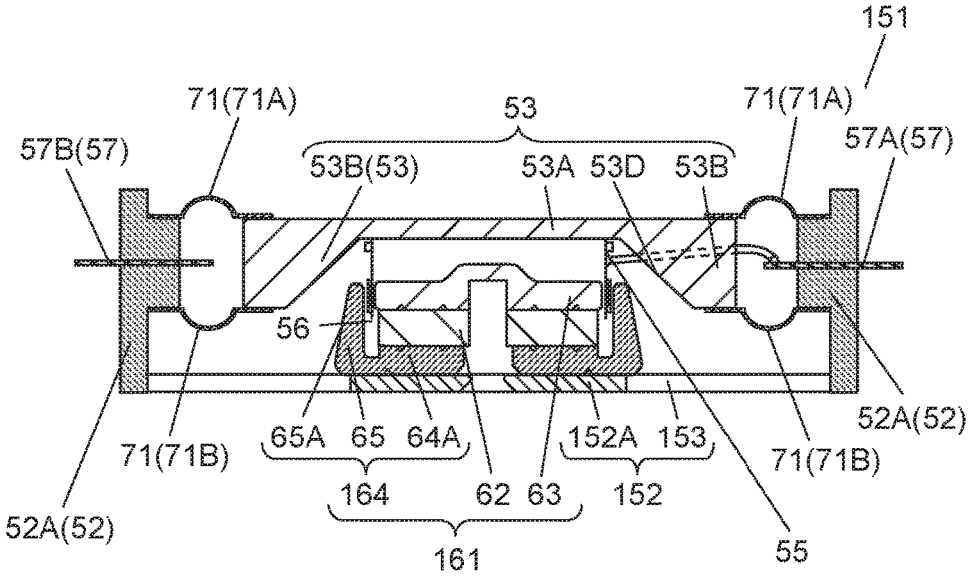
FIG. 12 is a sectional view of still another loudspeaker according to the present exemplary embodiment.
Figure 13:
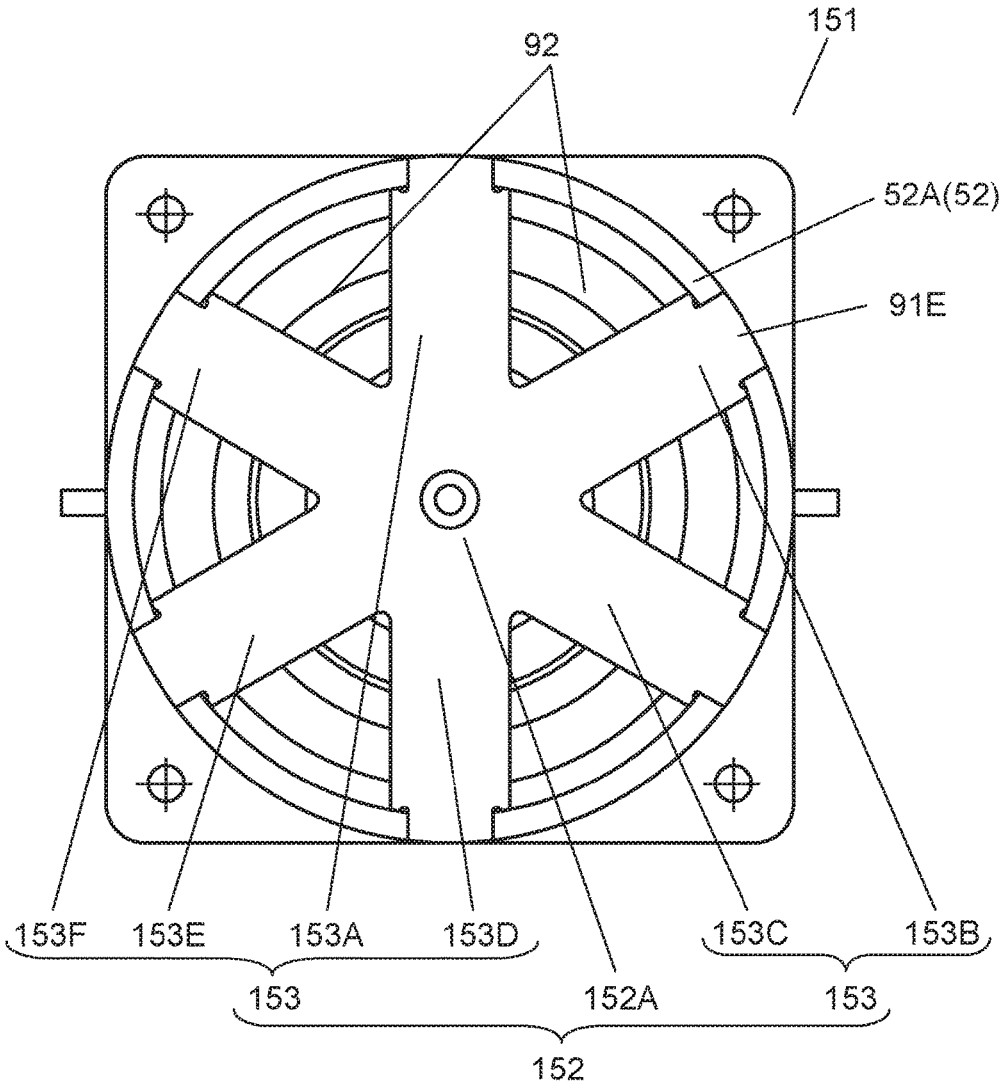
FIG. 13 is a rear view of the still another loudspeaker according to the present exemplary embodiment.

FIG. 12 is a sectional view of still another loudspeaker 151 according to the present exemplary embodiment. FIG. 13 is a rear view of yet another loudspeaker 151 according to the present exemplary embodiment. In loudspeaker 151, the same components as in loudspeakers 51 and 251 are denoted by the same reference numerals, and the description thereof will be omitted. Loudspeaker 151 includes magnetic circuit 161 and pedestal 152 instead of magnetic circuit 61 of loudspeaker 51. Pedestal 152 includes mounting part 152A and arms 153.

Magnetic circuit 161 includes magnet 62, top plate 63, and bottom plate 164. Bottom plate 164, which is a cylinder with a bottom, includes installation part 64A and yoke 65. Installation part 64A and yoke 65 are preferably integrally formed.

Mounting part 152A is formed in the center of pedestal 152. Magnetic circuit 161 is placed on the upper surface of mounting part 152A and is fixed to pedestal 152. The fixation may be achieved by screwing, bonding, or other methods.

The magnetic saturation of bottom plate 164 is likely to occur under the outer peripheral surface of magnet 62. For this reason, mounting part 152A is preferably made of magnetic material, such as hot-rolled steel plates (for example, SPHC and SPHD). As a result, mounting part 152A functions as a magnetic path in magnetic circuit 161. With this configuration, the magnetoresistance is small in the region under the outer peripheral surface of magnet 62, thereby achieving a low magnetic saturation of magnetic circuit 161 and a large magnetic flux density in magnetic gap 56.

Pedestal 152 includes arms 153 extending from mounting part 152A toward the outer periphery. The tips of arms 153 are fixed to frame 52 and, consequently, magnetic circuit 161 is fixed to frame 52. Mounting part 152A and arms 153 are preferably integrally formed, but may alternatively be formed separately and combined together. In this case, arms 153 are preferably made of non-magnetic material so as to prevent the magnetic flux in magnetic circuit 161 from leaking to arms 153.

Pedestal 152 preferably includes a plurality of arms 153 arranged at regular intervals. FIG. 13 shows six arms 153A-153F extending radially from mounting part 152A toward the outer periphery. Arms 153A-153F are preferably arranged at 60-degree intervals around the center of mounting part 152A. When magnetic circuit 161 is connected to frame 52 by arms 153, each two adjacent arms 153 are separated by opening 92. Openings 92 allow diaphragm 53 to vibrate without being disturbed by the sound pressure (back pressure) from its rear side.

Similar to arms 91, arms 153 are preferably provided at their tips with engaging portions 91E to be engaged with frame 52. Frame 52 preferably has to-be-engaged portions 52E to be engaged with engaging portions 91E. Engaging portions 91E can be, for example, projections such as bump. Note here that to-be-engaged portions 52E can be, for example, recesses such as grooves and cutouts. The projections can be fitted into the recesses so that pedestal 152 can be fixed to frame 52.

In addition, as shown in FIG. 9, arms 153 may have fins 93 on the outer periphery so as to increase at least one of the surface area and volume of arms 153, thereby efficiently cooling magnetic circuit 161.

Pedestal 152 can be a flat metal plate, so that fins 93 can be formed integrally with pedestal 152 by sheet metal working, thereby having a high productivity of the loudspeaker. Moreover, as shown in FIG. 10, installation part 64A may have fins 94 on its outer periphery.

Figure 14:
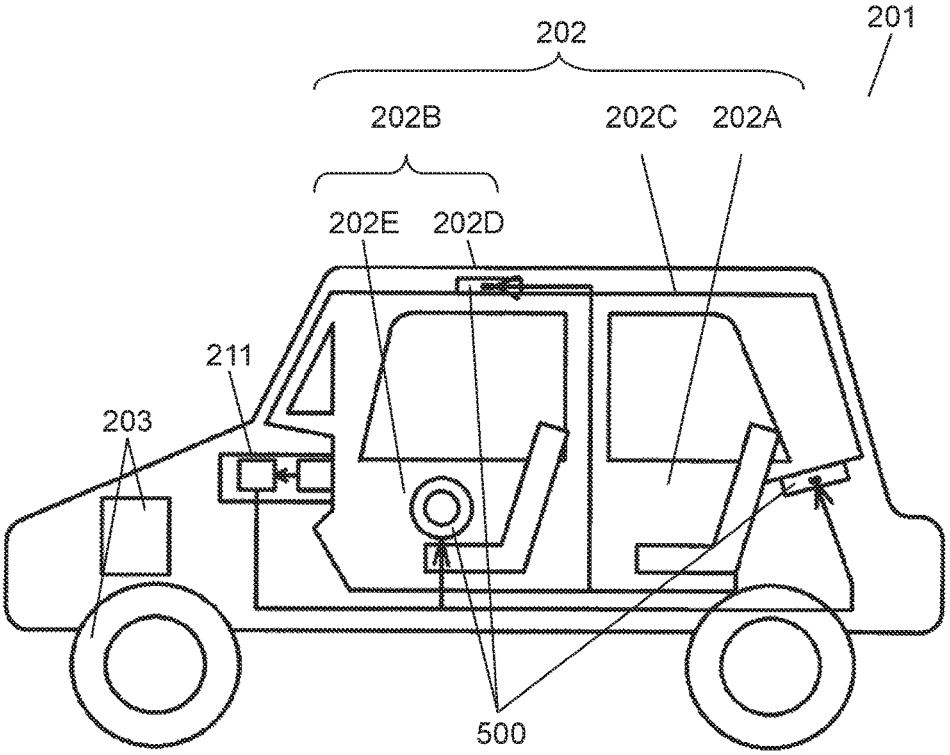
FIG. 14 is a conceptual view of a mobile device according to the present exemplary embodiment.

FIG. 14 is a conceptual view of mobile device 201 according to the present exemplary embodiment. Mobile device 201 is equipped with loudspeaker 500. Loudspeaker 500 represents one of loudspeakers 51, 151, and 251 according to the present exemplary embodiment. In FIG. 14, mobile device 201 is an automobile, but may be other vehicles such as ships, airplanes, trains, and motorcycles.

Mobile device 201 includes body 202, drive part 203, amplifier 211, and loudspeaker 500. Drive part 203, amplifier 211, and loudspeaker 500 are mounted in body 202. Drive part 203 may include an engine, a motor, tires, a steering wheel, and other parts. The output of amplifier 211 is supplied to loudspeaker 500. Amplifier 211 may include part of a car audio system, and additionally include a sound reproducing device. Also, amplifier 211 may include part of a car navigation system, and additionally include a display device.

Body 202 includes passenger space 202A. Loudspeaker 500 is placed to deliver sound to passenger space 202A. Body 202 may further include exterior part 202B and interior part 202C. Exterior part 202B, which isolates passenger space 202A from the outside, can be, for example, roof 202D or door 202E. Interior part 202C is located between exterior part 202B and passenger space 202A. Loudspeaker 500 is placed between interior part 202C and exterior part 202B, but may alternatively be placed in a dashboard, a rear tray (not shown), or other places.

Loudspeaker 500 of the present exemplary embodiment has a thin profile and therefore can have a short distance between interior part 202C and exterior part 202B. In other words, loudspeaker 500 can be placed even if the distance is short between interior and exterior parts 202C and 202B. Thus, the use of loudspeaker 500 as mobile device 201 expands passenger space 202A.

The above-described exemplary embodiment is an example to facilitate the understanding of the present invention and does not limit the invention thereto. The materials and shapes of the components of loudspeaker 500 described in the exemplary embodiment can be variously modified.

The present invention, without departing from the spirit thereof, may be modified or improved and may include equivalents thereof.

As described above, in the loudspeaker of the present disclosure, the magnetic circuit is located in the internal space of the frame. Furthermore, the plurality of arms is connected to the frame and project toward the outer periphery of the magnetic circuit, thereby allowing the loudspeaker to have a thin profile. In addition, the magnetic circuit is connected to the frame by the plurality of arms, and adjacent arms are separated by an opening. With this configuration, the frame does not need to have an opening for releasing the sound pressure generated on the rear side of the diaphragm, and hence, can have a simple shape. Furthermore, the sound pressure from the rear side of the diaphragm allows air to pass through the openings, thereby improving the effect of air-cooling the magnetic circuit.

INDUSTRIAL APPLICABILITY

The loudspeaker of the present disclosure has a thin profile and is therefore suitable for use especially in in-car audio systems and home audio systems.

The invention claimed is:

1. A loudspeaker comprising:

a frame having a cylindrical internal space;

a diaphragm located in the internal space of the frame;

an edge connecting an outer peripheral end of the diaphragm and the frame;

a magnetic circuit located in the internal space of the frame and having a magnetic gap, the magnetic circuit including:

a magnet; and a bottom plate including:

an installation part located on a first side of the magnet and magnetically connected to the magnet; and a plurality of arms; and a voice coil body including:

a cylindrical bobbin; and a voice coil wound around at least part of the bobbin, the voice coil body being located in a center of the diaphragm to provide the voice coil in the magnetic gap, wherein the plurality of arms is projected from the installation part toward an outer periphery and connected to the frame, wherein each of the plurality of arms has an engaging portion disposed at its tip, wherein the frame has at least one to-be-engaged portion configured to engage with the engaging portion, wherein the magnetic circuit becomes affixed to the frame to form the loudspeaker when the engaging portion is engaged with the at least one to-be-engaged portion, wherein the diaphragm includes a thin part and a thick part, the thin part being thinner than the thick part, and the thick part being arranged on outer periphery of the diaphragm, wherein an upper surface of the magnetic circuit is arranged to face the thin part, wherein a first end of the cylindrical bobbin is connected to the thin part, wherein the voice coil is wound around towards a second end of the cylindrical bobbin, wherein, when a drive signal is supplied to the voice coil, the diaphragm vibrates according to a direction and magnitude of the drive signal, and wherein a first portion of the edge is located on a front side of the diaphragm with respect to the center of the diaphragm in a thickness direction, and a second portion of the edge is located on a rear side of the diaphragm with respect to the center of the diaphragm in the thickness direction.

2. The loudspeaker of claim 1, wherein the magnetic circuit further includes:

a top plate located on a second side opposite to the first side of the magnet; and a yoke located around the top plate and facing the top plate with the magnetic gap therebetween, the yoke being magnetically connected to the magnet via the installation part.

3. The loudspeaker of claim 2, wherein at least one of the bottom plate and the yoke has a recess to hold an adhesive.

4. The loudspeaker of claim 1, wherein the arms and the installation part are integrally formed.

5. The loudspeaker of claim 1, wherein the arms are made of non-magnetic material.

6. The loudspeaker of claim 1, wherein each of the arms has a fin on an outer periphery thereof.

7. The loudspeaker of claim 1, wherein the installation part has a fin on an outer periphery thereof.

8. The loudspeaker of claim 1, wherein the engaging portion and the to-be-engaged portion are engaged with each other and bonded with an adhesive.

9. The loudspeaker of claim 1, wherein the engaging portion is a projection;

the to-be-engaged portion is a recess including:

an insertion slot; and a locking portion continuous with, and wider than, the insertion slot.

10. The loudspeaker of claim 1, wherein the frame is made of synthetic resin.

11. A loudspeaker comprising:

a frame having a cylindrical internal space;

a diaphragm located in the internal space of the frame;

an edge connecting an outer peripheral end of the diaphragm and the frame;

a magnetic circuit located in the internal space of the frame and having a magnetic gap, the magnetic circuit including:

a magnet; and a bottom plate including an installation part located on a first side of the magnet and magnetically connected to the magnet;

a voice coil body including:

a cylindrical bobbin; and a voice coil wound around at least part of the bobbin, wherein the voice coil body is located in a center of the diaphragm to provide the voice coil in the magnetic gap;

a mounting part connected to the magnetic circuit; and a plurality of arms projecting from the mounting part and connected to the frame, wherein each of the plurality of arms has an engaging portion disposed at its tip, wherein the frame has at least one to-be-engaged portion configured to engage with the engaging portion, wherein the magnetic circuit becomes affixed to the frame to form the loudspeaker when the engaging portion is engaged with the at least one to-be-engaged portion, wherein the diaphragm includes a thin part and a thick part, the thin part being thinner than the thick part, and the thick part being arranged on outer periphery of the diaphragm, wherein an upper surface of the magnetic circuit is arranged to face the thin part, wherein a first end of the cylindrical bobbin is connected to the thin part, wherein the voice coil is wound around towards a second end of the cylindrical bobbin, wherein, when a drive signal is supplied to the voice coil, the diaphragm vibrates according to a direction and magnitude of the drive signal, and wherein a first portion of the edge is located on a front side of the diaphragm with respect to the center of the diaphragm in a thickness direction, and a second portion of the edge is located on a rear side of the diaphragm with respect to the center of the diaphragm in the thickness direction.

12. The loudspeaker of claim 11, wherein the magnetic circuit further includes:

a top plate located on a second side opposite to the first side of the magnet; and a yoke located around the top plate and facing the top plate with the magnetic gap therebetween, the yoke being magnetically connected to the magnet via the installation part.

13. The loudspeaker of claim 11, wherein the arms and the mounting part are integrally formed.

14. The loudspeaker of claim 11, wherein the arms are made of non-magnetic material.

15. The loudspeaker of claim 11, wherein each of the arms has a fin on an outer periphery thereof.

16. The loudspeaker of claim 11, wherein the installation part has a fin on an outer periphery thereof.

17. A mobile body comprising:

a drive part mounted in the body;

an amplifier mounted in the body; and the loudspeaker of claim 1 being configured to receive an output of the amplifier.

18. The mobile body of claim 17, further comprising:

an interior part; and an exterior part covering an outer periphery of the interior part with a predetermined space from the interior part, and the loudspeaker is located in the space.

19. The mobile body of claim 18, wherein the exterior part is either a door or a roof.

20. A mobile body comprising:

a drive part mounted in the body;

an amplifier mounted in the body; and the loudspeaker of claim 11 being configured to receive an output of the amplifier.

* * * * *